US005404861A

United States Patent [19]

Wild

[11] Patent Number: 5,404,861

[45] Date of Patent: Apr. 11, 1995

[54] METHOD AND DEVICE FOR ASSESSING THE OPERATING CAPACITY OF A LAMBDA CONTROL

[75] Inventor: Ernst Wild, Oberriexingen, Germany

[73] Assignee: Robert Bosch GmbH, Stuttgart, Germany

[21] Appl. No.: 107,662

[22] PCT Filed: Jan. 14, 1993

[86] PCT No.: PCT/DE93/00017

§ 371 Date: Aug. 12, 1993

§ 102(e) Date: Aug. 12, 1993

[87] PCT Pub. No.: WO93/16277

PCT Pub. Date: Aug. 19, 1993

[30] Foreign Application Priority Data

Feb. 7, 1992 [DE] Germany ..... 42 03 502.3

[51] Int. Cl.[6] ..... F02D 41/22

[52] U.S. Cl. ..... 123/674; 123/690; 73/118.1

[58] Field of Search ..... 123/690, 688, 674, 675

[56] References Cited

U.S. PATENT DOCUMENTS 4,502,443 3/1985 Hasegawa et al. ..... 123/686

4,677,955 7/1987 Takao ..... 123/688

4,947,818 8/1990 Kamohara et al. ..... 123/479

5,065,726 11/1991 Klenk ..... 123/674

5,070,847 12/1991 Akiyama et al. ..... 123/674

FOREIGN PATENT DOCUMENTS 3533287 3/1986 Germany .

*Primary Examiner*—Andrew M. Dolinar

*Attorney, Agent, or Firm*—Michael J. Striker

[57] ABSTRACT

In a method for assessing the operating capacity of a lambda control, which outputs regulated values FR which are to fluctuate about a desired regulated value FR_DES, which lambda control is assisted by an adaptation outputting adaptation values, the current value of a decision quantity, which indicates the averaged absolute value of deviation of the regulated value from the desired regulated value, is calculated continuously, then the current value is compared with a decision-quantity threshold value SW_EW, and the faulty signal is output when the current value exceeds the decision-quantity threshold value. It is therefore also possible to recognize those fails which occur only in part ranges of the total range in which an internal-combustion engine, in which the fuel supply is set by means of the lambda control, can be operated.

8 Claims, 2 Drawing Sheets

METHOD AND DEVICE FOR ASSESSING THE OPERATING CAPACITY OF A LAMBDA CONTROL

The present invention relates to a method and a device for assessing the operating capacity of a lambda control of an internal-combustion engine, which outputs regulated values FR which are to fluctuate about a desired regulated value FR_DES.

In order to generate as little harmful gas as possible when internal-combustion engines are running, these are operated by means of a lambda control with pilot control. This makes it possible to determine fuel quantities which are to be fed respectively to the engine in accordance with the air intake, in such a way that a predetermined lambda value is maintained as accurately as possible. When values of operating quantities change, a value for the fuel metering matched to the changed operating values is determined immediately by the pilot control, and this value is then finely adjusted by means of the lambda control.

The pilot-control values for a particular internal-combustion engine are determined for in each case exactly fixed operating values and operating parameters. However, when an internal-combustion engine is operating under practical conditions, the current operating parameters often deviate from those which were used to determine the pilot-control values, for example a different fuel is used. The predetermined pilot-control values then do not exactly match the current operating situation. To remedy this deficiency, there are so-called learning or adaptive lambda-control systems. These output at least one adaptation value, by means of which the pilot-control values are corrected. The adaptation value is determined by means of the deviation between the regulated value output by a lambda controller and a desired regulated value.

Faults increasing the emission of harmful gas can occur when an internal-combustion engine is in operation. The Californian Environmental Authority CARB demands that a fault is to be indicated when the permissible limit value for a harmful gas is exceeded by 50% during the so-called FTP cycle. It has proposed, in this respect, that at least one adaptation value be monitored and a fault signal output when the latter exceeds a predetermined threshold value.

It was shown that methods and devices according to this proposal are not capable of indicating all the faults which cause the limit value for a harmful gas to be exceeded by 50% in the FTP cycle.

SUMMARY OF THE INVENTION

The object therefore was to provide a method and a device for assessing the operating capacity of a lambda control, which are capable of indicating difficulties in the control which lead to an undesirable increase in the emission of harmful gas.

The method according to the invention for assessing the operating capacity of a lambda control, which outputs regulated values FR which are to fluctuate about a desired regulated value FR_DES, which lambda control is assisted by an adaptation outputting adaptation values, is characterised in that the current value EW of a decision quantity, which indicates the averaged absolute value of deviation of the regulated values from the desired regulated value, is calculated continuously; and the current value is compared with a decision-quantity threshold value SW_EW; and a fault signal is output when the current value exceeds the decision-quantity threshold value.

Preferably, not only the decision values are used to assess whether the fault signal is to be output, but the values of the at least one adaptation quantity are also included. In this case, the fault signal is output either when the current decision value exceeds the associated threshold value or when an adaptation value exceeds its associated threshold value. In this case, where the decision value is used in addition to the adaptation values for assessing the operating capacity, it is a further advantage to determine the decision value with a higher time constant than the at least one adaptation value. Faults are then usually indicated in terms of the adaptation values, whereas an indication in terms of the decision value takes place only in special cases.

The finding, on which the method mentioned is based, is now to be illustrated by means of an example. Let it be assumed that, under high loads, the fuel pump on the lambda-controlled internal-combustion engine can no longer supply the fuel quantity required. A lean air/fuel mixture is then established. The result of this is that the regulated value output by the lambda control deviates from the desired regulated value. Consequently, the values of the decision quantity and of the adaptation quantities increase. After a time span of a maximum of a few tens of seconds, the high load range is left again. Because at least one adaptation value has been increased, a rich mixture is now set, as a result of which the regulated value now deviates from the desired regulated value to the other side than before. The at least one increased adaptation value is therefore reduced again. In contrast, the decision value is increased further, since, in contrast to the adaptation values, the averaged absolute value of deviation of the regulated values from the desired regulated value is an important factor for it.

Thus, only faults which take effect in the entire operating range of an internal-combustion engine, befit somewhat more or somewhat less in individual part ranges, can be indicated by means of the adaptation values. In contrast, not only these faults, but also those taking effect only in a part region can be detected by means of the decision value.

The device according to the invention for assessing the operating capacity of a lambda control, which outputs regulated values FR which are to fluctuate about a desired regulated value FR_DES, which lambda control is assisted by an adaptation outputting adaptation values, is characterised by:

a computing device for the continuous computation of the current value EW of a decision quantity which indicates the averaged absolute value of deviation of the regulated values from the desired regulated value; and a comparator device which compares the current value with a decision-quantity threshold value SW_EW and which outputs a fault signal when the current value exceeds the decision-quantity threshold value.

The novel features which are considered as characteristic for the invention are set forth in particular in the appended claims. The invention itself, however, both as to its construction and its method of operation, together with additional objects and advantages thereof, will be best understood from the following description of specific embodiments when read in connection with the accompanying drawings.

DESCRIPTION OF PREFERRED EMBODIMENTS

Figure 1:
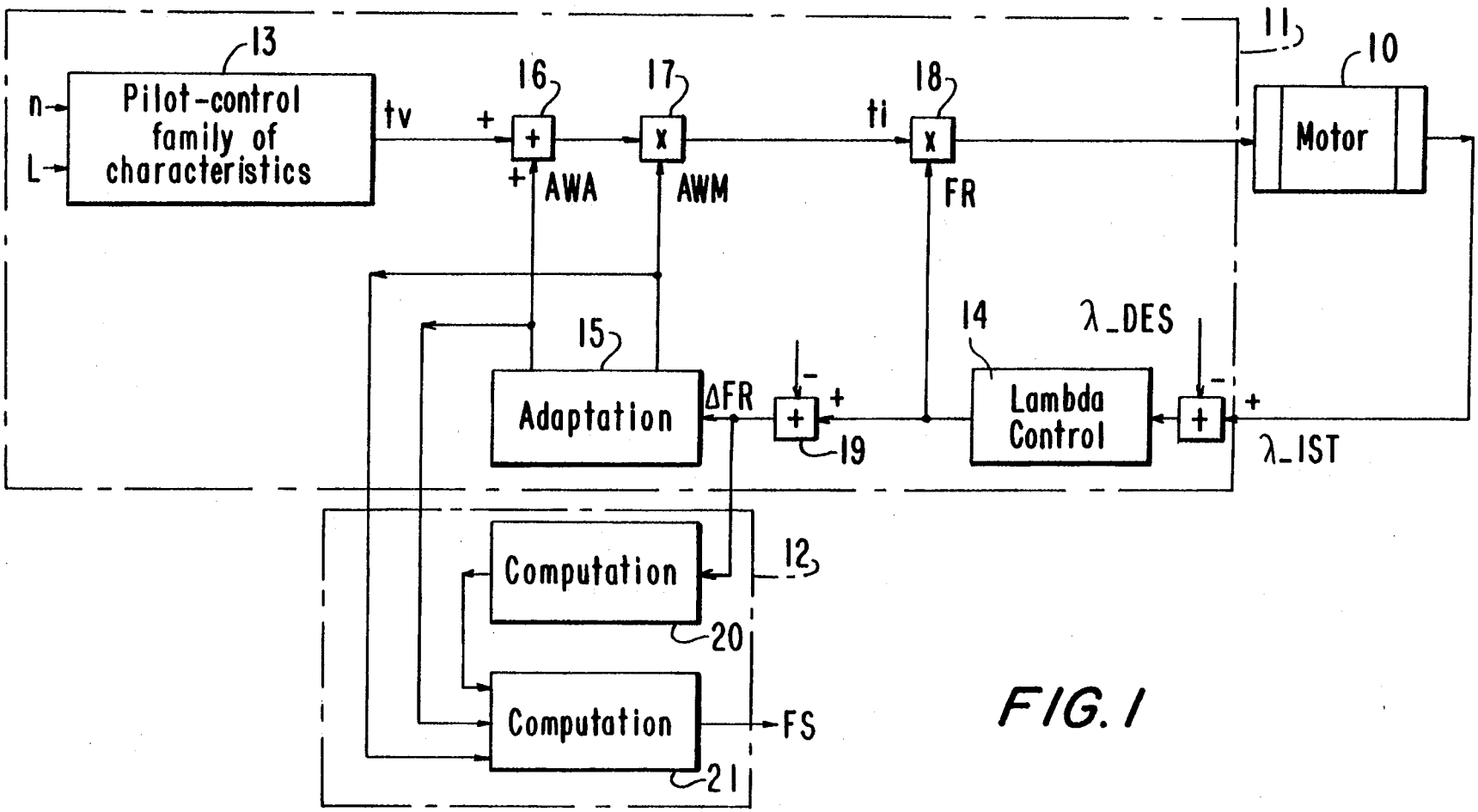
FIG. 1 shows an operating block diagram to explain a method according to the invention and a device according to the invention for assessing the operating capacity of a lambda control.

The block diagram of FIG. 1 shows an internal-combustion engine 10 with a lambda-control unit 11 having a pilot-controlled adaptive lambda control, and a fault-warning unit 12.

A pilot-control family of characteristics 13, a lambda control 14, an adaptation 15, an adaptation adder 16, an adaptation multiplier 17 and a control multiplier 18 are present in a lambda-control unit 11. The pilot-control family of characteristics 13 is addressed via speed values n and load values L and outputs pilot-control values tv for injection times. An adaptive adaptation value AWA is added to a respective pilot-control value in the adaptation adder 16, is then multiplied by a multiplicative adaptation value AWM in the adaptation multiplier 17, and is finally multiplied in the control multiplier 18 by a control factor FR. The latter is formed by the lambda control 14 in response to a control deviation between an actual lambda value λ_ACT and a desired lambda value λ_DES. The control factor FR is the regulated value of the lambda control. The desired regulated value "1" is subtracted from this regulated value in a subtraction device 19, and by means of the regulated-value deviation ΔFR thus formed the adaptation values AWA and AWM are computed by the adaptation 15.

It is pointed out that, in practice, there are numerous alternative versions of lambda-control units, but they all have essentially the same function as that explained above. Thus, even the pilot-control values tv can be determined in a wide variety of ways, for example also without a family of characteristics. The adaptation adder 16 and the adaptation multiplier 17 can also be located behind the control multiplier 18, instead of in front of it. Instead of two adaptation values, the adaptation 15 can also output only a single or also three such values or even more. Thus, at a lower speed and a high load, leakage-air faults can be adapted and are preferably taken into account additively before the logic operation with the regulated value. Multiplicative faults, such as are caused by changes in air pressure or changes in fuel properties, can be taken into account multiplicatively before or after the logic operation with the regulated value. Finally, opening and closing times of injection valves can be adapted at high speed and under a high load and be taken into account additively after the logic operation with the regulated value.

The fault-warning unit 12 contains a computing unit 20 and a comparator unit 21. A computing device 20 receives the regulated-value deviation ΔFR and calculates from this an expected value EW, preferably as a variance, that is to say as an average value of the squares of the regulated-value deviation, hence as:

$$EW=\overline{(\Delta FR)^2}.$$

Instead of the variance, however, the simple average value amount can also be calculated as a decision value, hence:

$$EW=\overline{|\Delta FR|}.$$

Furthermore, an event number can be used as a decision value, for example the number of which indicates how often the value |ΔFR| exceeds a threshold within a predetermined time span or within a predetermined number of investigated regulated-value deviations, hence:

$$EW=\text{frequency of } |\Delta FR| > \text{threshold value}.$$

The actual method of computation is not essential for determining the decision value EW, but it is important that an averaged absolute value of deviation be determined. It is important to use the amount so that both regulated-value deviations, such as are caused by the occurrence of a fault, and those brought about by the disappearance of this fault are taken into account. The averaging is important, so that not every rapidly transitory higher regulated-value deviation results in the output of a fault signal FS by the comparator unit 21 which, in particular, compares the respective current decision value EW with a decision-quantity threshold value and which outputs the said fault signal when the decision value exceeds the decision-quantity threshold value. In the exemplary embodiment, the averaging is carried out by means of a digital low-pass filter, as explained further below with reference to step s2 of the flow diagram of FIG. 2. For this, a low-pass constant corresponding to a time constant of a few tens of seconds in respect of a corresponding integrating element is used.

A method, such as is now described with reference to FIG. 2, can be performed by means of the functional units according to FIG. 1.

Figure 2:
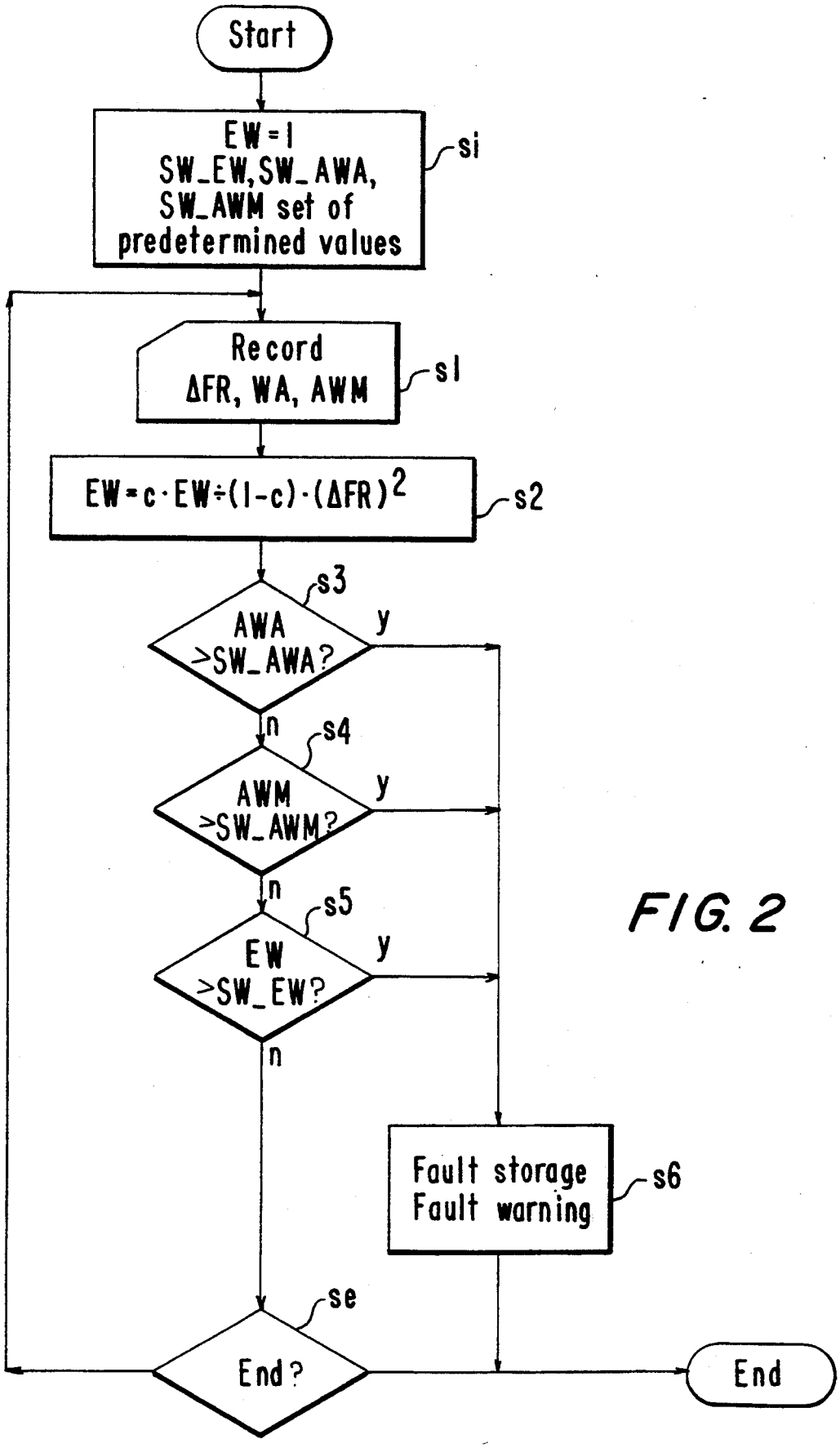
FIG. 2 shows a flow diagram to describe a method for assessing the operating capacity of a lambda control.

After the start of the method of FIG. 2, the expected value EW is set at "1" in an initialising step si. Moreover, threshold values S_W EW, SW_AWA and SW_AWM are set at predetermined values. In the exemplary embodiment, it is the value 1.2 in all three instances.

The method then enters a loop, in which the current values ΔFR of the regulated-quantity deviation, AWA of the adaptive adaptation quantity and AWM of the multiplicative adaptation quantity are first recorded in a step s1. In the subsequent step s2 already mentioned above, the expected value EW is computed by digital low-pass filtering from the previously applicable value EW and the current regulated-quantity deviation AFR by means of the formula indicated in the block for step s2. In this formula, c is the low-pass constant which has the value 0.99 in the exemplary embodiment.

There now follow decision steps s3 to s5 which ask, in order, whether the values AWA, AWM and EW are each higher than the associated threshold value SW_AWA, SW_AWM and SW_EW. If none of these questions is answered in the affirmative, a concluding step se checks whether an end condition is satisfied. If this is so, the method is interrupted, whereas otherwise the loop is run through again from step s1. However, if it emerges, in the requests in the steps s3 to s5, that one of the threshold values is exceeded, the fault is entered in a fault memory in a step s6, and a fault signal is output, for example lighting up a warning lamp. The end of the method is reached after step s6.

The method just described can be modified in many ways, provided only that it is guaranteed that a check is made as to whether the averaged amount of regulated-quantity deviation ΔFR exceeds an associated threshold value. Thus, the comparisons made by means of the adaptation values can be omitted completely. Furthermore, a modification is possible to the effect that the end of the method is not reached after the fault-warning step s6, but the said loop is always run through again from step s1 despite the detected fault and a fault-curing possibility is thereby afforded, for example to the effect that the fault entry is cancelled again if a fault has not occurred again after a predetermined high number of runs. If the fault alarm has been triggered because the decision value exceeds its associated threshold value, the values of selected operating quantities, such as were present when the fault occurred, can also be stored at the same time together with this fault. Then, when the same operating state is assumed again several times, without a new fault alarm taking place, the fault entry can be cancelled again.

It is essential for the method according to the invention and the device according to the invention that, when a range with faulty pilot control is approached, the regulated value output by the lambda control deviates from the desired regulated value, thus causing at least one adaptation value and decision value to vary. When the faulty range is left again, the changed adaptation value no longer matches the fault-free range, and therefore the desired value output by the lambda control now deviates from the desired regulated value in the other direction. Since the amounts of these deviations are averaged during the computation of the decision value, they have a greater effect on the decision value than on the at least one adaptation value which is reduced again immediately as soon as the sign of the regulated-value deviation has been reversed. It is therefore possible, by means of the decision value, to detect faults which cannot be detected by means of an adaptation value.

It will be understood that each of the elements described above, or two or more together, may also find a useful application in other types of constructions and methods differing from the types described above.

While the invention has been illustrated and described as embodied in a method and device for assessing the operating capacity of a lambda control, it is not intended to be limited to the details shown, since various modifications and structural changes may be made without departing in any way from the spirit of the present invention.

Without further analysis, the foregoing will so fully reveal the gist of the present invention that others can, by applying current knowledge, readily adapt it for various applications without omitting features that, from the standpoint of prior art, fairly constitute essential characteristics of the generic or specific aspects of this invention.

What is claimed as new and desired to be protected by Letters Patent is set forth in the appended claims.

I claim:

1. A method of assessing operating capacity of a lambda control, comprising the steps of outputting regulated values FR which are to fluctuate about a desired regulated value FR_DES;

assisting the lambda control by an adaptation outputting adaptation values AWA, AWM;

continuously calculating a current value EW of a decision quantity, which indicates an averaged absolute value of deviation of regulated values from the desired regulated value;

comparing the current value with a decision-quantity threshold value SW-EW; and outputting a fault signal FS when the current value EW exceeds the decision-quantity threshold value SW_EW.

2. A device for assessing operating capacity of a lambda control, which outputs regulated values FR which are to fluctuate about a desired regulated value FR_DES, and the lambda control is assisted by an adaptation outputting adaptation values, the device comprising computing means for continuous computation of a current value EW of a decision quantity which indicates an averaged absolute value of deviation of regulated values from a desired regulated value; and comparing means which compare the computed current value with a decision-quantity threshold value SW_EW and which outputs a fault signal when current value exceeds the decision-quantity threshold value.

3. A method of assessing operating capacity of a lambda control, comprising the steps of outputting regulated values FR which are to fluctuate about a desired regulated value FR_DES;

assisting the lambda control by an adaptation outputting adaptation values AWA, AWM;

continuously calculating a current value EW of a decision quantity, which indicates an averaged absolute value of deviation of regulated values from the desired regulated value;

comparing the current value with a decision-quantity threshold value SW—EW; and outputting a fault signal FS when the current value EW exceeds the decision-quantity threshold value SW_EW, said calculating the current value EW of a decision quantity including calculating the current value as follows:

$$EW=\overline{|(FR-FR_DES)|}.$$

4. A method of assessing operating capacity of a lambda control, comprising the steps of outputting regulated values FR which are to fluctuate about a desired regulated value FR_DES;

assisting the lambda control by an adaptation outputting adaptation values AWA, AWM;

continuously calculating a current value EW of a decision quantity, which indicates an averaged absolute value of deviation of regulated values from the desired regulated value;

comparing the current value with a decision-quantity threshold value SW-EW; and outputting a fault signal FS when the current value EW exceeds the decision-quantity threshold value SW_EW, said calculating the current value EW of a decision quantity including calculating the current value as follows:

$$EW=\overline{|(FR-FR_DES)|_2}.$$

5. A method of assessing operating capacity of a lambda control, comprising the steps of outputting regulated values FR which are to fluctuate about a desired regulated value FR_DES;

assisting the lambda control by an adaptation outputting adaptation values AWA, AWM;

continuously calculating a current value EW of a decision quantity, which indicates an averaged absolute value of deviation of regulated values from the desired regulated value;

comparing the current value with a decision-quantity threshold value SW-EW; and outputting a fault signal FS when the current value EW exceeds the decision-quantity threshold value SW_EW, said calculating the current value EW of a decision quantity including calculating the current value as follows:

$$EW = \text{frequency of } |(FR - FR_DES)| > \text{threshold value.}$$

6. A method of assessing operating capacity of a lambda control, comprising the steps of outputting regulated values FR which are to fluctuate about a desired regulated value FR_DES;

assisting the lambda control by an adaptation outputting adaptation values AWA, AWM;

continuously calculating a current value EW of a decision quantity, which indicates an averaged absolute value of deviation of regulated values from the desired regulated value;

comparing the current value with a decision-quantity threshold value SW—EW;

outputting a fault signal FS when the current value EW exceeds the decision-quantity threshold value SW_EW; and averaging to obtain the averaged absolute value of deviation and including digital low-pass filtering.

7. A method of assessing operating capacity of a lambda control, comprising the steps of outputting regulated values FR which are to fluctuate about a desired regulated value FR_DES;

assisting the lambda control by an adaptation outputting adaptation values AWA, AWM;

continuously calculating a current value EW of a decision quantity, which indicates an averaged absolute value of deviation of regulated values from the desired regulated value;

comparing the current value with a decision-quantity threshold value SW—EW;

outputting a fault signal FS when the current value EW exceeds the decision-quantity threshold value SW_EW; and outputting the fault signal also when at least one adaptation value exceeds an associated adaptation threshold value SW_AWA, SW_AWM.

8. A method of assessing operating capacity of a lambda control, comprising the steps of outputting regulated values FR which are to fluctuate about a desired regulated value FR_DES;

assisting the lambda control by an adaptation outputting adaptation values AWA, AWM;

continuously calculating a current value EW of a decision quantity, which indicates an averaged absolute value of deviation of regulated values from the desired regulated value;

comparing the current value with a decision-quantity threshold value SW—EW;

outputting a fault signal FS when the current value EW exceeds the decision-quantity threshold value SW_EW; and determining the expected value EW of a decision quantity with a higher time constant than the at least one adaptation value AWA, AWM.

* * * * *